US011963596B2

(12) United States Patent
Debenedictis et al.

(10) Patent No.: US 11,963,596 B2
(45) Date of Patent: Apr. 23, 2024

(54) HAIR STYLING DEVICE

(71) Applicant: JAPHAM GROUP LIMITED, Bedfordshire (GB)

(72) Inventors: Alfredo Debenedictis, Bedfordshire (GB); Janusz Lucien Holland, Bedfordshire (GB); Mark Christopher Hughes, Bedfordshire (GB); Martin Malcolm Harris, Bedfordshire (GB); James Robert Nelson, Bedfordshire (GB)

(73) Assignee: JAPHAM GROUP LIMITED, Bedfordshire (GB)

( * ) Notice: Subject to any disclaimer, the term of this patent is extended or adjusted under 35 U.S.C. 154(b) by 310 days.

(21) Appl. No.: 17/618,464

(22) PCT Filed: Jun. 14, 2019

(86) PCT No.: PCT/EP2019/065773
§ 371 (c)(1),
(2) Date: Dec. 11, 2021

(87) PCT Pub. No.: WO2019/238961
PCT Pub. Date: Dec. 19, 2019

(65) Prior Publication Data

US 2022/0322802 A1 Oct. 13, 2022

(51) Int. Cl.
*A45D 1/12* (2006.01)
*A45D 2/00* (2006.01)
*A45D 1/00* (2006.01)

(52) U.S. Cl.
CPC ..... *A45D 2/001* (2013.01); *A45D 1/12* (2013.01); *A45D 2001/004* (2013.01)

(58) Field of Classification Search
CPC ... A45D 1/00; A45D 1/04; A45D 1/06; A45D 1/08; A45D 1/12; A45D 2001/004
See application file for complete search history.

(56) References Cited

U.S. PATENT DOCUMENTS 1,494,507 A 5/1924 Ruffio
1,609,810 A 12/1926 Gates
(Continued)

FOREIGN PATENT DOCUMENTS

CN 108813896 A 11/2018
CN 208339131 U 1/2019
(Continued)

OTHER PUBLICATIONS

Steenbeck, L. J., "Third Party Observations (Article 115 EPC)", Jun. 29, 2016, pp. 1-5.
(Continued)

*Primary Examiner* — Rachel R Steitz
(74) *Attorney, Agent, or Firm* — HULTQUIST, PLLC; Steven J. Hultquist

(57) ABSTRACT

The invention relates to a hair styling device, and in particular to a hair straightener. The hair styling device (10; 210) has a first arm (12; 212) and a second arm (14; 214), the first and second arms being moveable relative to one another between a closed or operative condition and an open or inoperative condition. The first member (12; 212) has a first heating panel (16; 116; 216) and the second member (14; 214) has a second heating panel (18; 118; 218). The heating panels (16, 18; 116, 118; 216, 218) are corrugated to increase the length of the path the hair must take between the heating panels. The first and second heating panels are spaced apart in the operative condition so as not to press or clamp the hair therebetween. The first member (12; 212) also has a first pressing panel (26; 126; 226) and the second member (14; 214) also has a second pressing panel (28; 128; 228), the first and second pressing panels in their operative position engaging so that the hair is pressed between the pressing panels.

20 Claims, 4 Drawing Sheets

(56) References Cited

U.S. PATENT DOCUMENTS

| | | | |
|---|---|---|---|
| 1,636,967 | A | 7/1927 | Perry |
| 1,701,270 | A | 2/1929 | Moskovitz et al. |
| 1,709,981 | A | 4/1929 | Headington |
| 1,806,711 | A | 5/1931 | Salzman |
| 1,814,116 | A | 7/1931 | Borden |
| 1,827,785 | A | 10/1931 | Frederics |
| 1,831,487 | A | 11/1931 | Elam |
| 1,877,776 | A | 9/1932 | Pezzella |
| 1,884,305 | A | 10/1932 | Shelton |
| 1,894,624 | A | 1/1933 | Marcel |
| 1,895,653 | A | 1/1933 | Fisher |
| 1,951,154 | A | 3/1934 | Klein |
| 1,981,362 | A | 11/1934 | Joyce |
| 1,997,690 | A | 4/1935 | Katcher |
| 2,197,821 | A | 4/1940 | Webster |
| 2,593,544 | A | 4/1952 | Davis et al. |
| 2,595,844 | A | 5/1952 | Graham |
| 2,791,225 | A | 5/1957 | Simmons |
| 2,867,223 | A | 1/1959 | Anzalone |
| 2,906,272 | A | 9/1959 | Heidel |
| 2,935,070 | A | 5/1960 | Auz |
| 3,213,859 | A | 10/1965 | Mizell et al. |
| 3,213,860 | A | 10/1965 | Mizell et al. |
| 3,223,093 | A | 12/1965 | Winters |
| 3,255,765 | A | 6/1966 | Sturdivant |
| 3,605,762 | A | 9/1971 | Fromann |
| 3,786,819 | A | 1/1974 | Cantrell |
| 3,805,810 | A | 4/1974 | Savala |
| 3,835,292 | A | 9/1974 | Walter et al. |
| 3,894,547 | A | 7/1975 | Scivoletto |
| 3,968,805 | A | 7/1976 | Sobeck, Jr. |
| 4,148,330 | A | 4/1979 | Gnaga |
| 4,177,824 | A | 12/1979 | Gnaga |
| 4,222,398 | A | 9/1980 | Fromman |
| 4,342,323 | A | 8/1982 | Rick et al. |
| 4,603,246 | A | 7/1986 | Giancario |
| 4,829,156 | A | 5/1989 | Thompson |
| 4,884,583 | A | 12/1989 | Long, Jr. |
| 5,119,847 | A | 6/1992 | Powell et al. |
| 5,133,372 | A | 7/1992 | Seja et al. |
| 5,323,792 | A | 6/1994 | Caruso |
| 5,327,919 | A | 7/1994 | Hanlon |
| 5,472,003 | A | 12/1995 | Frame et al. |
| 5,584,309 | A | 12/1996 | De Beneditis et al. |
| 5,771,906 | A | 6/1998 | De Benedictis |
| 5,813,419 | A | 9/1998 | Brams |
| 5,899,213 | A | 5/1999 | Kimata |
| 6,354,305 | B1 | 3/2002 | Janouch et al. |
| 6,386,206 | B2 | 5/2002 | Lee |
| 6,637,441 | B2 | 10/2003 | Kennedy et al. |
| 6,647,989 | B1 | 11/2003 | De Benedictis |
| 6,962,159 | B1 | 11/2005 | Adam |
| 7,121,285 | B2 | 10/2006 | Kraus |
| 7,198,049 | B2 | 4/2007 | Elmer et al. |
| 7,305,995 | B2 | 12/2007 | Tojo et al. |
| 7,487,783 | B2 | 2/2009 | Saito et al. |
| 7,500,487 | B2 | 3/2009 | Kobayashi et al. |
| 7,513,259 | B2 | 4/2009 | Kimata et al. |
| 7,770,586 | B2 | 8/2010 | Tojo et al. |
| 7,789,093 | B2 | 9/2010 | Tojo et al. |
| 8,132,575 | B2 | 3/2012 | Tojo et al. |
| 8,256,438 | B2 | 9/2012 | Tojo et al. |
| 8,448,651 | B2 | 5/2013 | Honnefeller et al. |
| 8,607,804 | B2 | 12/2013 | De Benedictis |
| 8,651,118 | B2 | 2/2014 | De Benedictis et al. |
| 8,733,374 | B2 | 5/2014 | De Benedictis et al. |
| 8,869,808 | B2 | 10/2014 | De Benedictis |
| 9,027,570 | B2 | 5/2015 | De Benedictis et al. |
| 9,138,039 | B2 | 9/2015 | De Benedictis et al. |
| 9,185,957 | B2 | 11/2015 | Richmond et al. |
| 9,345,302 | B2 | 5/2016 | Chung |
| 9,615,643 | B2 | 4/2017 | De Benedictis et al. |
| 9,615,644 | B2 | 4/2017 | De Benedictis et al. |
| 9,629,434 | B2 | 4/2017 | DeBenedictis et al. |
| 9,788,625 | B2 | 10/2017 | DeBenedictis et al. |
| 9,854,891 | B2 | 1/2018 | De Benedictis et al. |
| 10,238,196 | B2 | 3/2019 | DeBenedictis |
| 10,485,317 | B2 | 11/2019 | DeBenedictis et al. |
| 10,772,406 | B2 | 9/2020 | DeBenedictis et al. |
| 2004/0231689 | A1 | 11/2004 | Kobayashi et al. |
| 2004/0231690 | A1 | 11/2004 | De Benedictis |
| 2004/0237991 | A1 | 12/2004 | Glucksman et al. |
| 2005/0241663 | A1 | 11/2005 | Getahun |
| 2005/0268933 | A1 | 12/2005 | Kimata et al. |
| 2005/0284493 | A1 | 12/2005 | Allen |
| 2006/0124148 | A1 | 6/2006 | Tojo et al. |
| 2006/0157078 | A1 | 7/2006 | Tojo et al. |
| 2006/0196523 | A1 | 9/2006 | Choi |
| 2007/0017541 | A1 | 1/2007 | Wilmore |
| 2007/0065489 | A1 | 3/2007 | Tojo et al. |
| 2007/0068547 | A1 | 3/2007 | Gurth et al. |
| 2007/0084479 | A1 | 4/2007 | Ryan-Jakimas |
| 2008/0035167 | A1 | 2/2008 | Chan |
| 2008/0216859 | A1* | 9/2008 | Chan ..... A45D 1/04 132/223 |
| 2008/0236610 | A1 | 10/2008 | Bartels |
| 2008/0302381 | A1 | 12/2008 | Tojo et al. |
| 2009/0056738 | A1 | 3/2009 | Tojo et al. |
| 2010/0083978 | A1 | 4/2010 | Hottenrott et al. |
| 2010/0170883 | A1 | 7/2010 | Legrain et al. |
| 2010/0263684 | A1 | 10/2010 | De Benedictis |
| 2011/0220141 | A1 | 9/2011 | Chan |
| 2012/0186601 | A1 | 7/2012 | Ungar et al. |
| 2013/0025621 | A1 | 1/2013 | De Benedictis |
| 2013/0125919 | A1 | 5/2013 | De Benedictis et al. |
| 2013/0263882 | A1 | 10/2013 | Kim et al. |
| 2014/0076351 | A1 | 3/2014 | De Benedictis et al. |
| 2014/0216494 | A1 | 8/2014 | De Benedictis et al. |
| 2015/0000689 | A1 | 1/2015 | De Benedictis |
| 2015/0114425 | A1 | 4/2015 | Park |
| 2015/0128987 | A1 | 5/2015 | De Benedictis et al. |
| 2015/0201727 | A1 | 7/2015 | De Benedictis et al. |
| 2015/0216281 | A1 | 8/2015 | De Benedictis et al. |
| 2016/0255937 | A1 | 9/2016 | De Benedictis et al. |
| 2016/0353853 | A1 | 12/2016 | De Benedictis et al. |
| 2017/0006989 | A1 | 1/2017 | DeBenedictis et al. |
| 2018/0020796 | A1 | 1/2018 | DeBenedictis et al. |
| 2018/0177273 | A1 | 6/2018 | Jeong |
| 2018/0228262 | A1 | 8/2018 | Bonnemaire et al. |
| 2019/0053595 | A1 | 2/2019 | DeBenedictis |
| 2021/0022468 | A1 | 1/2021 | DeBenedictis et al. |

FOREIGN PATENT DOCUMENTS

| | | | |
|---|---|---|---|
| DE | 172581 | C | 2/1905 |
| DE | 20119863 | U1 | 12/2001 |
| EP | 0606691 | A1 | 7/1994 |
| EP | 1417906 | A1 | 5/2004 |
| EP | 1909609 | B1 | 11/2011 |
| EP | 2392222 | A1 | 12/2011 |
| FR | 434713 | | 9/1911 |
| FR | 641097 | A | 7/1928 |
| FR | 38041 | A | 3/1931 |
| FR | 2310105 | A1 | 11/1976 |
| FR | 2937839 | A1 | 5/2010 |
| FR | 434713 | | 9/2011 |
| GB | 303043 | A | 12/1928 |
| GB | 1036583 | A | 7/1966 |
| GB | 1157814 | A | 7/1969 |
| GB | 302952 | A | 12/1978 |
| GB | 2413492 | A | 11/2005 |
| GB | 2498417 | B | 12/2013 |
| JP | S60140502 | U | 9/1985 |
| JP | 61-10102 | U | 1/1986 |
| JP | S6278801 | U | 5/1987 |
| JP | S633808 | A | 1/1988 |
| JP | 03123402 | A | 12/1991 |
| JP | 03123402 | U | 12/1991 |
| JP | 2002520076 | A | 7/2002 |
| JP | 2005324073 | A | 11/2005 |
| KR | 1020100010088 | A | 2/2010 |
| KR | 1020130116097 | A | 10/2013 |
| KR | 101424122 | B1 | 7/2014 |
| KR | 1020170055290 | A | 11/2017 |

(56) References Cited

FOREIGN PATENT DOCUMENTS

| | | | |
|---|---|---|---|
| KR | 1020170109307 | A | 11/2017 |
| KR | 101894759 | B1 | 8/2018 |
| WO | 9939608 | A1 | 8/1999 |
| WO | 0008967 | A1 | 2/2000 |
| WO | 2005082198 | A1 | 9/2005 |
| WO | 2008062293 | A1 | 5/2008 |
| WO | 2008102317 | A2 | 8/2008 |
| WO | 2008132345 | A2 | 11/2008 |
| WO | 2009077747 | A2 | 6/2009 |
| WO | 2012093045 | A1 | 7/2012 |
| WO | 2017055811 | A1 | 4/2017 |

OTHER PUBLICATIONS

Van Der Scheer, Robbert, "Correspondence Concerning Investigation of Rowenta Curl Active, Model CF 6510 Product", Jun. 29, 2016, pp. 1-2.

* cited by examiner

HAIR STYLING DEVICE

CROSS-REFERENCE TO RELATED APPLICATION

This is a United States national phase under 35 USC § 371 of International Patent Application No. PCT/EP2019/065773 filed Jun. 14, 2019. The disclosure of such application is hereby incorporated herein by reference in its entirety, for all purposes.

FIELD OF THE INVENTION

The invention relates to a hair styling device, and in particular to a hair straightener.

As with most of the known hair straighteners, the present invention can be used to straighten hair or to add a wave to hair.

For convenience, the following specification will refer to the use of the hair straightener upon a woman's hair, but the invention can also be used by men.

BACKGROUND TO THE INVENTION

It has long been desired to style a woman's hair, i.e. to add waves or curls to naturally straight hair or to straighten naturally wavy or curly hair. To style hair it is necessary to modify some of the chemical bonds which give the hair its natural form. The chemical bonds can be modified chemically with a perming solution, or through the application of heat and/or pressure.

A hair straightener is a particular form of hair styling device which uses heat and pressure to style hair. Hair straighteners were originally referred to as "straightening irons" to reflect the fact that they replicated the action of ironing the hair, i.e. pressing the hair between a heated "iron" and a flat surface.

Most hair straighteners comprise a pair of arms which are hinged relative to one another, each arm carrying an electrical heating panel. With the arms in their open condition the user inserts the proximal or scalp end of a chosen length of hair between the arms and then presses the arms together so that the length of hair is pressed between the heating panels. The hair straightener is then moved away from the scalp and the length of hair is heated and pressed as it is pulled between the panels. The hair is styled by the heat and pressure applied to the hair as it passes between the panels.

To straighten the hair the arms are oriented so that the heating panels are substantially perpendicular to the scalp and the length of hair is pulled in a substantially linear direction between the panels. It is also possible, however, to use a hair straightener to add a wave or curl to the length of hair by orienting the arms relative to the scalp so that the hair is forced to bend around a relatively sharp edge as it leaves the heating panels.

The incorporation of ceramic heaters into hair straighteners has significantly increased their utility. Ceramic heaters have the advantage that they can increase the temperature of the heating panels relatively quickly. Also, ceramic heaters can readily permit the heating panels to reach temperatures exceeding 200° C., it being recognised that such temperatures will enable quick and long-lasting styling.

The use of ceramic heaters has also enabled manufacturers to reduce the width of the heating panels and thereby to provide a more aesthetically pleasing product. In particular, the higher temperature of the heating panels enables the hair to reach the temperature required for styling more quickly; the panels do not need to be as wide as was previously necessary in order for the hair to reach the required styling temperature.

Because of the differences between hair types, there is no single heat and pressure combination which is effective for producing a long-lasting style for all women. Instead, it is necessary for individuals to learn through practice how much pressure to apply to the length of hair between the heating panels and how quickly to move the heating panels away from her scalp in order to cause the desired styling of her particular hair. Often, the user will pass the same length of hair between the heating panels more than once until the desired style is achieved.

The heat and pressure applied by the heating panels also acts to flatten the cuticle of the hair. Whilst hair is naturally substantially circular in cross-section, flattening the cuticle (and thereby flattening the cross-section) can increase the reflection from the hair and enhance the sheen upon the hair. Many users believe that a hair straightener makes their hair look more healthy because of the increased sheen achieved by flattening the cuticle.

Some manufacturers of hair straighteners have sought to make them more effective, and in particular to make the style more long-lasting, by actively cooling the hair as it leaves the heating panels. U.S. Pat. No. 6,354,305 for example describes a hair straightener with a curved heating zone defined by opposing heating panels between which the hair is passed whilst it is pressed. A separate curved cooling zone defined by opposing cooling surfaces is also provided. The user is able to pass a length of hair through the heating zone to soften and style the hair, and then to pass the hair through the cooling zone where the style is said to be "frozen". U.S. Pat. No. 6,354,305 discloses another arrangement in which the heating and cooling zones are planar and arranged next to one another.

EP 1 909 609 discloses a hair styling device of similar form to a conventional hair straightener comprising a pair of arms carrying opposing heating panels between which the user's hair is passed. The arms also carry opposing cooling panels so that the user can pass the hair between the heating panels followed by the cooling panels, the hair being pressed between each pair of opposing panels.

The hair styling device of GB 2 498 417 discloses a somewhat similar arrangement but with cooling panels to either side of the heating panels.

Korean patent applications 101 424 122, 2010 0010088 and 2013 0116097 also disclose hair straighteners having heating panels and cooling panels between which the hair is passed whilst it is pressed.

International patent application WO 2008/062293 discloses a hair straightener with a pair of arms, the arms having opposing heating panels and cooling panels. An embodiment is disclosed in which the cooling panel of each arm can pivot relative to the heating panel of that arm, so that the user can utilise the heating panels alone, or the heating panels followed by the cooling panels.

Hair crimpers are another type of hair styling device. Hair crimpers differ from hair straighteners in utilising corrugated heating panels. Also, unlike hair straighteners in which the hair is moved between the heating panels when the panels are pressed together, in hair crimpers the hair is clamped statically between the crimping panels until the style is set. Accordingly, the user styles discrete parts of a length of hair sequentially by clamping a part of the length of hair, then separating the heating panels and re-positioning them along the length of hair before clamping another part of the length of hair, and so on until all of the length of hair has been styled.

Hair wavers, including jumbo wavers, share the same operating principle as hair crimpers, but have larger amplitude corrugations so as to form waves of larger amplitude in the user's hair.

Accordingly, whilst hair straighteners and hair crimpers/wavers share the feature of opposing heating panels, and share the principle of operation that the user applies pressure to the hair between the heating panels to style the hair, they differ in that (usually) the hair is moved between the heating panels with a hair straightener, but (usually) is not moved between the heating panels with a hair crimper/waver.

Whilst the words "press" and "clamp" (and their derivatives) can often be used interchangeably, in the present specification the word "press" is used for a hair straightener and the like which is designed to style hair by applying pressure to hair which is moving relative to the panels, and the word "clamp" is used for a hair crimper and the like which is designed to style hair by applying pressure to hair which is static relative to the panels.

EP 1 909 609 also discloses the use of a heating zone and a cooling zone with a (removable) crimping panel, i.e. the same arms with the same heating and cooling panels can be used with flat panels as a hair straightener, or with corrugated panels as a hair crimper.

EP 0 606 691 discloses a hair straightener which is suited to frizzy hair (having a large number of small curls). Unlike a conventional hair straightener the device is used to repeatedly clamp the hair between the heating panels. Also unlike a conventional hair straightener the heating panels are corrugated. The corrugations are however, relatively shallow, having an amplitude between ⅕th and ⅓₀th of the wavelength—which is significantly shallower than the corrugations of a conventional hair crimper/waver. The hair straightener is used like a conventional hair crimper as set out above, i.e. the user styles discrete parts of a length of hair sequentially by clamping a part of the length of hair, then separating the heating panels and re-positioning them along the length of hair before clamping another part of the length of hair. The form of the corrugations apparently causes the hair to be straightened as it is repeatedly clamped therebetween.

In one embodiment of EP 0 606 691 the corrugated heating panels comprise secondary heating panels which are each connected to a planar (primary) heating panel. Whereas the corrugated heating panels can be clamped together the planar heating panels are spaced apart by about 0.4 mm. The planar heating panels comprise around ⅓ and the corrugated heating panels comprise around ⅔ of the total width of the heating panels. The terms "primary" and "secondary" are used to reflect the fact that in use the hair is heated between the planar panels before it is clamped between the corrugated panels.

Notwithstanding that EP 0 606 691 is used mainly to clamp the hair between the corrugated panels, a finishing stage is disclosed in which the hair is pressed between the corrugated panels, i.e. the planar panels and the corrugated panels are together slid along a length of hair from the root end to the free end, similarly to conventional hair straighteners.

It is understood that the regular and repeated use of hair styling devices, and in particular the over-styling of hair, can damage the hair. The regular and repeated use of hair straighteners and/or hair crimpers can for example cause long-lasting damage to the hair. It is recognised that heating the hair to a high temperature, applying a large pressure to the hair, and stretching the hair as the heating panels are pulled away from the scalp, can all cause long-lasting damage, especially when these effects are combined.

SUMMARY OF THE INVENTION

It is an object of the present invention to provide a hair styling device, and in particular a hair straightener, which is as effective as the known devices in producing a long-lasting style, whilst reducing the damage caused (or likely to be caused) to the user's hair.

According to the first aspect of the invention there is provided a hair styling device comprising a first member and a second member, the first and second members being moveable relative to one another between a closed or operative condition and an open or inoperative condition, the first member having a first heating panel and the second member having a second heating panel, the first and second heating panels being corrugated and adapted to heat a length of hair as the length of hair moves therebetween, the first and second heating panels being closer together in the operative condition than in the inoperative condition and being spaced apart in the operative condition whereby the length of hair is not pressed between the heating panels in use, the first member also having a first pressing panel and the second member also having a second pressing panel, the first and second pressing panels being substantially planar and being closer together than the heating panels in the operative condition.

The inventors have appreciated that it is not necessary to apply heat and pressure to the length of hair at the same time, and instead these operations can be separated somewhat. Whilst the length of hair can be heated continuously as it passes between the members, it is only pressed for a portion of that passage. The length of hair can thereby undergo the combined effects of heating, pressing and stretching for a much shorter path, and ideally a much shorter time, than with known hair straighteners, thereby reducing the likelihood of damage to the hair.

Providing corrugated heating panels increases the path along which the length of hair must travel as it passes between the heating panels, without increasing the overall width of the panels. Contrary to the teaching of EP 0 606 691 therefore, for a given rate of movement, the length of hair will take longer to pass between corrugated panels than planar panels of the same overall width. The longer travel time increases the temperature which the length of hair will reach before it leaves the heating zone between the heating panels. It is desirable to minimise the overall width of the hair styling device to increase its aesthetic appeal. Also contrary to EP 0 606 691, the pressing panels are substantially planar so as to minimise the path along which the length of hair must travel as it passes between the pressing panels. Since the combined effects of heating, pressing and stretching are experienced as the hair passes between the pressing panels, reducing the path (and therefore the time) for which the combined effects are applied is expected to minimise the likelihood of damage to the hair. It is also understood that pressing panels which are substantially planar are most effective in straightening hair.

Unlike conventional hair straighteners, the planar panels are not required to impart all of the required heat to the hair and to press the hair to form the desired style. The hair is heated between the corrugated heating panels to a styling temperature before it enters between the planar pressing panels and before any pressing takes place. It is expected that the heated length of hair will be styled rapidly as it is pressed between the planar pressing panels, and that the pressing panels can be made narrower than the heating panels of conventional hair straighteners. For a given rate of travel the length of hair can therefore be pressed for a shorter period of time than with conventional hair straighteners, which is expected to reduce the likelihood of damage to the hair, even if the hair is maintained at its styling temperature between the pressing panels. For example, whilst most conventional hair straighteners have heating panels which are more than 20 mm wide, it is expected that the pressing panels of the present invention could be significantly less than 20 mm wide without reducing the styling performance.

The pressing panels can also be heated, either directly by dedicated (ceramic) heaters, or passively by conduction from the heating panels. The temperature of the pressing panels can if desired be the same as, or nearly the same as, the temperature of the heating panels. Notwithstanding the combined heating and pressing between the pressing panels, the smaller width of the pressing panels is expected to reduce the likelihood of damage to the hair.

It is understood that the hair is most vulnerable to damage when it has been heated to its styling temperature. With conventional hair straighteners the hair must be moved (and is typically pulled and stretched) between the heating panels as it is pressed and whilst it is maintained at its styling (maximum) temperature. In addition to the possibly reduced temperature between the pressing panels, the present invention allows the width of the pressing panels to be reduced so as to reduce the path (and time) for which the hair is pulled by the user, and pressed, whilst at its most vulnerable.

It will be understood that deep corrugations will increase the path of travel as compared to shallow corrugations. Deep corrugations will, however, increase the frictional resistance to movement of the hair between the heating panels. Thus, even though the hair is not pressed between the heating panels the fact that the hair must follow the corrugations means that it will necessarily engage the peaks which will cause drag upon the length of hair. Accordingly, deep corrugations will maximise the path of travel for the hair, and shallow corrugations will minimise the drag.

The drag upon the hair in the heating zone can be reduced if desired by using a low friction coating upon the heating panels, and also by using rollers at the peaks of the corrugations (it being understood that a large proportion of the total drag upon the hair will occur at the corrugation peaks). The rollers can be unheated if desired so that they are maintained at a somewhat lower temperature than the remainder of the heating panels, whereby the hair only directly engages the heating panels where they are at a reduced temperature. Alternatively, an insulating material can be located at the peaks of the corrugations to reduce the temperature of the heating panels where they are directly engaged by the hair.

Unlike hair crimpers in which the length of hair is clamped between corrugated heating panels so as to acquire a style determined by the corrugations, in the present invention the hair moves past the peaks and troughs and is therefore not styled by the corrugations. In the present invention the corrugations are provided to cause the hair to move along a convoluted and longer path between the heating panels. This firstly causes the hair to engage the peaks of both of the heating panels as it passes therebetween and thereby to acquire heat rapidly by direct contact with the heating panels. This secondly causes the length of hair to remain between the heating panels for a longer period of time (for a given rate of movement of the hair straighteners) so as to increase the duration for which the hair is acquiring heat.

Desirably, the pressing panels are maintained at a lower temperature in use than the first and second heating panels. Unlike EP 0 606 691 in which the corrugated panels are heated to the same temperature as the planar panels, and notwithstanding that the pressing panels of the present invention can also be heated, they may be heated to a significantly lower temperature than the heating panels so that the length of hair experiences a significant reduction in temperature as it moves from the heating panels to the pressing panels. In embodiments in which the pressing panels are heated, a temperature difference of perhaps 30-60° C. can be maintained between the heating panels and the pressing panels, but greater or smaller temperature differences can be utilised if desired. Notwithstanding that the hair (and the pressing panels) may be significantly hotter than the ambient temperature as the hair moves between the pressing panels, the hair is nevertheless cooled as it leaves the heating zone. It will be understood that the pressure which is applied to the hair by the pressing panels therefore occurs at a lower temperature than that of the heating panels (and at a lower temperature than the panels of a conventional hair straightener) and this is also expected to be significantly less damaging to the hair.

Desirably, the first pressing panel is movable relative to the first heating panel between an operative position and an inoperative position, and the second pressing panel is movable relative to the second heating panel between an operative position and an inoperative position. It is intended that the pressing panels are too narrow (and perhaps also not sufficiently hot) to style hair on their own and will only work in conjunction with the heating panels. To style hair immediately adjacent to the scalp it is necessary to apply the heating panels directly to that part of the hair. Since the pressing panels "follow" the heating panels along the hair as the hair styling device is moved away from the scalp, in this desirable embodiment the pressing panels are moved away during the initial part of the styling operation so that the hair adjacent to the scalp can be styled. The pressing panels can be moved into their pressing position, to press the heated hair adjacent to the user's scalp, when the hair styling device has moved sufficiently far away from the user's scalp.

Preferably, the heating panels in the operative condition are spaced apart by at least 0.5 mm, ideally by more than 1 mm, and perhaps as much as 3 mm. Whilst the gap between the heating panels is small, it is nevertheless sufficient to allow a "ribbon" of hair (i.e. a section which is shallow but wide) to pass between the heating panels without being pressed.

The number of corrugations can be chosen to suit the application. It will be understood that the corrugations are primarily provided to increase the path length for the hair between the heating panels. The same increased path length can be provided by one large corrugation or several smaller corrugations and both are within the scope of the present invention. Preferably there is at least one corrugation on each heating panel, and desirably at least two corrugations on each heating panel.

Whilst it is stated that the heating panels are spaced apart in the operative condition, that does not preclude isolated parts of the heating panels touching, even parts between which the hair is passed. For example, if rollers are provided at the peaks of some or all of the corrugations so as to reduce the drag upon the hair, the roller(s) could engage the trough of the other heating panel. Notwithstanding that the length of hair would be momentarily pressed as it passes the roller it is not expected that such momentary pressing of the heated hair would significantly increase the likelihood of damage to the hair.

However, since it is desired that the heating panels are maintained at a desired separation, the first member or arm and the second member or arm preferably have at least one set of cooperating spacing formations which act to maintain a predetermined gap between the heating panels in their operative condition.

Desirably, the first member and the second member are elongate with first and second ends, the first and second members being connected together at a pivoting joint located adjacent to the first ends of the members. The cooperating spacing formation(s) is preferably located adjacent to the second ends of the members, i.e. at the opposite end to the pivoting joint where it is particularly effective in its spacing function. Desirably there are two cooperating spacing formations located adjacent to the second ends of the members, and preferably the two cooperating formations are spaced apart across the members.

Preferably the first member or arm and the second member or arm have at least one set of cooperating aligning formations which act to maintain the alignment of the members (and therefore maintain the alignment of the heating and pressing panels) in the operative condition. The aligning members will ideally also perform a guiding function to bring the respective panels into proper alignment as they move from their inoperative condition to their operative condition.

Desirably the first member or arm and/or the second member or arm is asymmetrical in plan view. Since the device should be used so that the hair passes between the heating panels before it passes between the pressing panels it is desirable to alert the user to the correct orientation of the device in relation to her scalp. An asymmetrical member (or members) is an effective way to alert the user to the correct orientation. Preferably, the asymmetry is created by a discontinuity (such as a step, for example) along one of the side edges of the member(s). Desirably the step is located adjacent to a handle part of the members, and ideally between the handle part and the heating and pressing panels.

It can be arranged that the pressing panels are also movable towards and away from the heating panels, and specifically into and out of engagement with the heating panels. In such an arrangement, the pressing panels can be passively heated by conduction from the heating panels when the respective panels are in engagement. Alternatively, the pressing panels can be separated from the heating panels with an air gap therebetween to minimise the temperature of the pressing panels (and increase the temperature difference between the heating panels and pressing panels).

According to the second aspect of the invention there is provided a hair styling device comprising a first member and a second member, the first and second members being moveable relative to one another between an operative condition and an inoperative condition, the first member having a first heating panel and the second member having a second heating panel, the first and second heating panels being adapted to heat a length of hair as the length of hair moves therebetween and being spaced apart in the operative condition, the length of hair moving along a heating path between the first and second heating panels in use, the first member also having a first pressing panel and the second member also having a second pressing panel, the first and second pressing panels being substantially planar, the length of hair moving along a pressing path between the first and second pressing panels in use, the length of the heating path being greater than the length of the pressing path.

This aspect of the invention clarifies that a given length of hair has a longer path (and therefore spends a greater amount of time) between the heating panels than between the pressing panels; a longer period of time spent between the heating panels allows the length of hair to acquire more heat and be raised to a higher temperature; a shorter period of time spent between the pressing panels reduces the duration during which the hair experiences the combined (and potentially damaging) effect of heat and pressure.

Preferably the length of the heating path is at least twice, and ideally at least three times, the length of the pressing path.

According to the third aspect of the present improvement there is provided a hair styling device comprising a first member and a second member, the first and second members being moveable relative to one another between an operative condition and an inoperative condition, the first member having a first heating panel and the second member having a second heating panel, the first and second heating panels being adapted to heat a length of hair as the length of hair moves therebetween, the first and second heating panels being closer together in the operative condition than in the inoperative condition, the first member also having a first pressing panel and the second member also having a second pressing panel, the first and second pressing panels being planar and having a width of at least 3 mm.

According to the third aspect the heating panels are not required to be spaced apart in the operative condition. The invention according to this aspect can operate even if the heating panels can touch other across their full width, whereby the heating panels are spaced apart in use only by the presence of hair between the panels. Whilst such arrangements are less desirable because the length of hair can be pressed between the heating panels, they can nevertheless achieve effective hair styling.

The minimum width of the planar panels distinguishes from the prior art jumbo wavers and the like which have corrugated heating/pressing panels, no part of which is planar.

Preferably, the first and second members have cooperating formations which engage in the operative condition. Thus, the formation of the first member can cooperate with a formation of the second member to limit the relative closing movement of the members and thereby define the operative condition. In preferred embodiments in which the heating panels are spaced apart in the operative condition the spacing can be determined by the engagement of the pressing panels and/or by the cooperating formations.

Ideally, the cooperating formations also increase the structural rigidity of the hair styling device in use and can also help to guide the first and second members as they are moved to the operative condition.

Preferably the cooperating formations comprise projections or upstands on one of the first and second members, and a correspondingly-shaped recess on the other of the first and second members.

As with the prior art hair straighteners, the pressing panels can if desired be actively cooled by a coolant fluid (such as ambient air), by a refrigerant, or by the Peltier effect for example. The coolant fluid (etc.) can act directly upon the pressing panels or indirectly upon the pressing panels (for example the pressing panels could be in thermal connection with radiating fins or the like). It is, however, expected that the present invention can provide an effective hair styling device without cooling of the pressing panels.

To avoid unnecessary repetition, it is confirmed that one or more of the features which are described in relation to each aspect of the invention can be combined with any and all features of the other aspects of the invention with which they are compatible.

BRIEF DESCRIPTION OF THE PREFERRED EMBODIMENTS

The invention will now be described in more detail, by way of example, with reference to the accompanying schematic drawings, in which.

DETAILED DESCRIPTION

Figure 1:
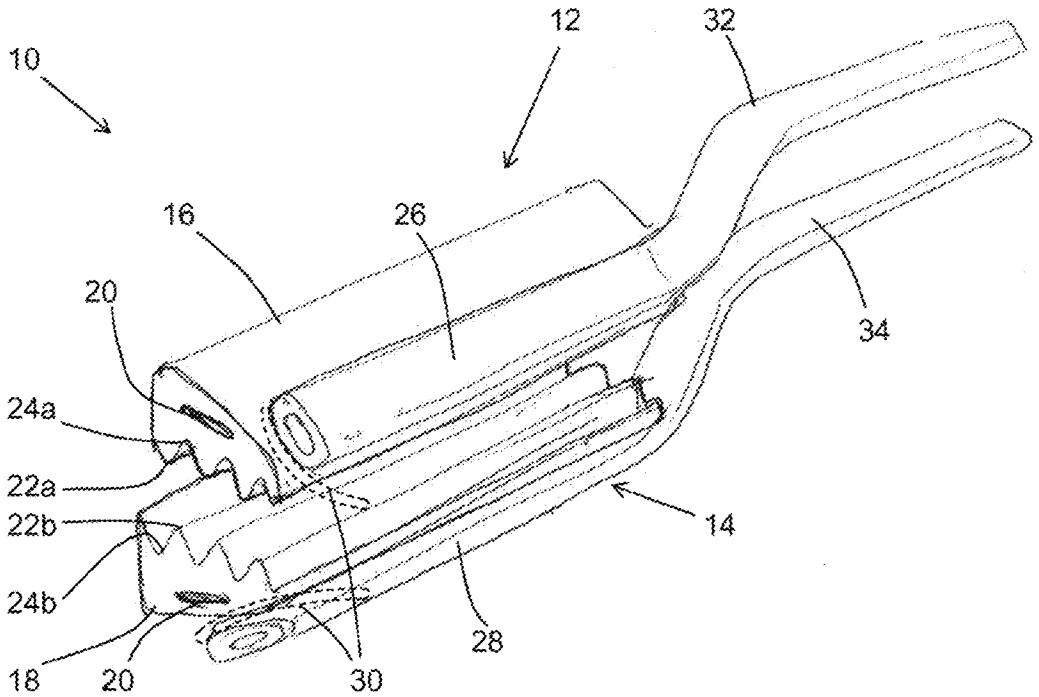
FIG. 1 shows a perspective view of relevant parts of a first embodiment hair styling device according to the present invention.

The hair styling device 10, only the relevant parts of which are shown in FIG. 1, comprises a first member or arm 12 and a second member or arm 14. In conventional fashion, the first and second arms are moveable relative to one another between the open or inoperative condition shown in FIG. 1 and a closed or operative position (not shown). The arms 12, 14 may be relatively moveable by way of a hinge or pivot joint, in known fashion.

The first arm 12 has a first heating panel 16 and the second arm 14 has a second heating panel 18. The first and second heating panels 16, 18 are metallic and each has a ceramic heater 20. The ceramic heaters 20 are actuated by an electrical current controlled by a controller (not shown) of the hair styling device 10. Preferably, the controller is able to control the temperature of the heating panels 16, 18 to one of several discrete temperatures so that the user can with practice determine the best temperature setting for her hair.

It will be understood that in the inoperative (open) position shown the heating panels 16 and 18 are separated by a distance great enough to permit the introduction of a chosen length of hair between the heating panels 16, 18. The hair styling device 10 may be configured similarly to a conventional hair straightener with the arms 12, 14 connected by a pivot joint at one end of the arms and with an open gap at the other end of the arms whereby the user can readily insert the length of hair into the open gap and between the heating panels 16, 18 when the heating panels are in their inoperative position (similar for example to the third embodiment of FIGS. 4-6). In known fashion, when the length of hair has been inserted between the heating panels 16, 18, the hair styling device can be moved adjacent to the user's scalp to the position at which it is desired to commence the hair styling.

When correctly positioned relative to the user's scalp, the arms 12, 14 can be moved together from the position shown in FIG. 1, specifically into an operative condition in which the heating panels 16, 18 are close to one another and present a small gap through which the length of hair can pass between the heating panels 16, 18.

Figure 2:
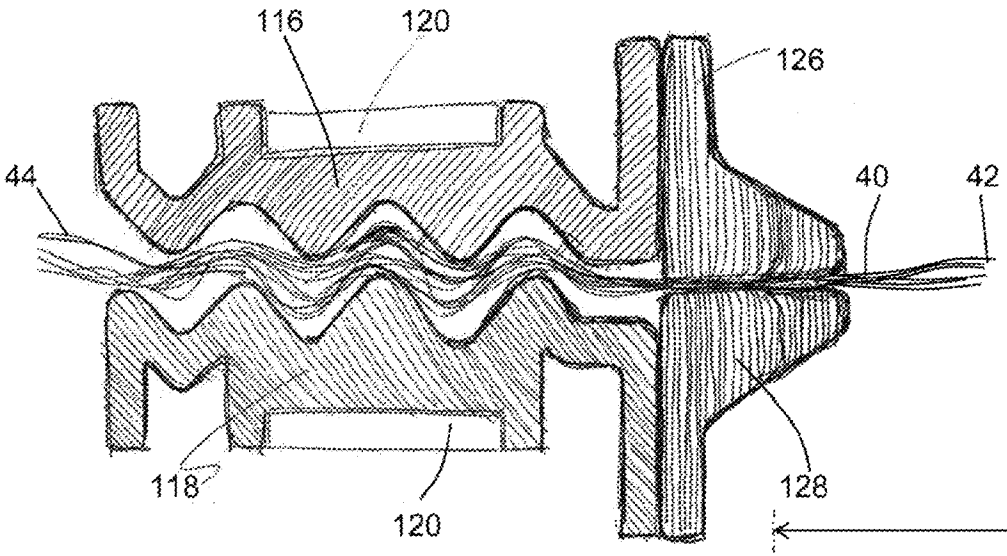
FIG. 2 shows a sectional view of the heating and pressing panels of a second embodiment in one possible configuration.
Figure 3:
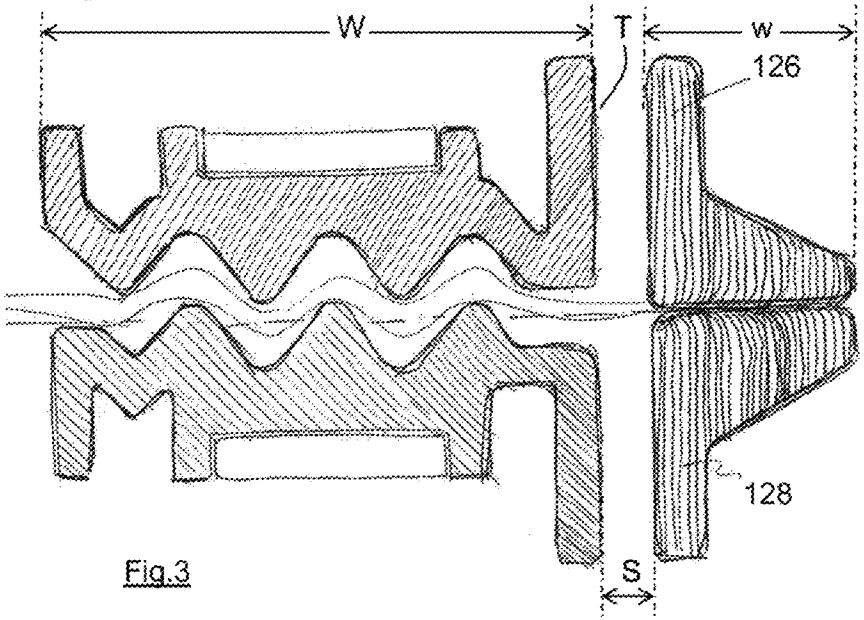
FIG. 3 shows a sectional view of the heating and pressing panels of the second embodiment in another possible configuration.

The first and second heating panels 16, 18 are corrugated, with the peaks 22*a* and troughs 24*a* of the first heating panel 16 facing the troughs 24*b* and peaks 22*b* respectively of the second heating panel 18 (see the similar opposing peaks and troughs of the embodiment of FIGS. 2 and 3).

Importantly, when the arms 12, 14 are brought together so that the first and second heating panels 16, 18 are in their operative position (not shown), the heating panels 16, 18 remain spaced apart so that the length of hair is not pressed between the heating panels. A length of hair between the heating panels 16, 18 will nevertheless be heated, primarily by conduction as the hair engages the heating panels 16, 18.

The corrugations enhance the heating of the length of hair in two ways. Firstly, the convoluted path which the length of hair must take as it passes between the heating panels 16, 18 increases the path of travel for a given width of the heating panels, and thereby increases the duration for which the length of hair remains between the heating panels (for a given rate of movement of the hair styling device 10 away from the user's scalp). Secondly, the convoluted path causes the length of hair to engage the peaks 22*a,b* of the heating panels 16, 18 and the greater the engagement with the heating panels the greater the heat conduction into the hair.

The first of these enhancements can be understood by reference to FIGS. 2 and 3—the convoluted path of travel of the length of hair 40 as it passes between the heating panels 116, 118 is significantly longer than the overall width W of the heating panels.

The second of these enhancements can also be understood by reference to FIGS. 2 and 3—forcing the length of hair 40 to undertake a convoluted path between the heating panels 116, 118 causes the length of hair to engage the peaks of the corrugations as it is pulled between the heating panels.

As shown in FIG. 1, the first arm 12 also has a first pressing panel 26 and the second arm 14 also has a second pressing panel 28. The first and second pressing panels 26, 28 may if desired be maintained at the same temperature as the heating panels 16, 18, and may have their own dedicated ceramic heating elements.

Alternatively, the pressing panels 26, 28 may be maintained at a lower temperature in use than the first and second heating panels 16, 18. A temperature differential may for example be obtained by actively heating the pressing panels 26, 28 to a lower temperature than the heating panels 16, 18. Alternatively, means may be provided to seek to maintain the temperature of the pressing panels close to the ambient temperature. The latter alternative may be achieved by an air gap or a thermal barrier between the heating panels and the pressing parts and/or by mounting radiating fins upon the extensions 32, 34 of the respective pressing panels 26, 28.

Importantly, in the embodiment of FIG. 1 the first pressing panel 26 is movable relative to the first heating panel 16 and the second pressing panel 28 is movable relative to the second heating panel 18. Each of the pressing panels 26, 28 is movable relative to its heating panel 16, 18 between an inoperative position as shown in FIG. 1 and an operative position (not shown). In their operative position the first and second pressing panels 26, 28 are close enough together to press a length of hair therebetween.

In other embodiments of the invention each pressing panel is fixed relative to the heating panel of that arm, so that the heating panel and the pressing panel of each arm move together between the operative condition and the inoperative condition. It is nevertheless preferred that in such embodiments there is an air gap or thermal barrier between the heating panel and the pressing panel of each arm so that the temperature of the pressing panel can be set independently to (and preferably at a lower temperature than) the heating panel.

In the embodiment shown in FIG. 1 each of the pressing panels 26, 28 is mounted directly to its respective heating panel 16, 18, and can move relative to its heating panel along a path 30 shown in dotted outline (the curved path 30 for example representing a channel along which a projecting boss at the end of the respective pressing panel can slide).

Accordingly, whilst the length of hair is not pressed as it passes between the heating panels 16, 18, it is pressed as it passes between the pressing panels 26, 28. The length of hair is therefore heated and pressed as required to style the length of hair, but these two operations are effectively carried out separately (and sequentially) by different parts of the hair styling device 10.

The pressing panels 26, 28 are shown as being generally oval in shape in FIG. 1, so that they have a relatively small contact area in their operative position. In an alternative embodiment the contact regions of the pressing panels can be planar so as to increase the contact area (as in the embodiment of FIGS. 2 and 3). Even with an oval shape, however, the pressure upon the previously-heated hair can be sufficient to style the hair as it passes between the pressing panels 26, 28.

It will be seen from FIG. 1 that in their inoperative position the first and second pressing panels 26, 28 are moved out of alignment with the heating panels 16, 18. This allows the heating panels 16, 18 to be moved close to the user's scalp without the pressing panels getting in the way. It will be understood that during use the pressing panels 26, 28 "follow" the heating panels 16, 18 along the length of hair being styled. Since it is usually desired to commence the style immediately adjacent to the user's scalp it is necessary that the heating panels 16, 18 be positionable very close to the user's scalp at the start of the styling operation. Moving the pressing panels 26, 28 relative to the heating panels 16, 18 as represented in FIG. 1 will permit the heating panels 16, 18 to be moved very close to the user's scalp. The hair adjacent to the user's scalp can therefore be heated and, as the hair styling device 10 is moved away from the user's scalp, the pressing panels 26, 28 can be moved to their operative position to press and style the heated hair.

FIGS. 2 and 3 show a second embodiment of the present invention, which embodiment has two possible configurations (in both the operative and inoperative positions) as shown and as described below. Importantly, both of FIGS. 2 and 3 show the heating panels 116, 118 in their operative condition, and the pressing panels 126, 128 in their operative positions. It will be understood by reference to FIG. 1 that the first member or arm (not shown) which carries the panels 116, 126, and the second member or arm which carries the panels 118, 128, can be moved apart to separate the respective panels, perhaps in a similar fashion to conventional hair straighteners.

If desired, the pressing panels 126, 128 may also be moved apart relative to the heating panels to an inoperative position whereby to permit the trailing end T of the heating panels to be moved very close to the user's scalp at the commencement of a styling operation.

In this embodiment the heating panels 116, 118 are made of metal and each has a ceramic heater 120. The pressing panels 126, 128 are also made of metal and in this embodiment have no heating elements.

The pressing panels 126, 128 in this embodiment are movable relative to the respective heating panels 116, 118 between the two configurations shown in FIGS. 2 and 3, dependent upon the temperature required for the pressing panels.

In the position of FIG. 2 each pressing panel 126, 128 engages its respective heating panel 116, 118, and since the pressing panels are metallic they will acquire heat by conduction from their heating panel. It can in particular be arranged that in this configuration the temperature of the pressing panels 116, 118 in use is substantially the same as that of the heating panels 116, 118.

In the position of FIG. 3, on the other hand, the pressing panels 126, 128 are spaced from the respective heating panels 116, 118 by a spacing S, the spacing S providing an air gap and thereby avoiding any conduction of heat from the heating panels 116, 118.

It will be understood that the pressing panels 126, 128 may nevertheless be heated by conduction through other connected parts of the hair styling device which are not shown in FIGS. 2 and 3, by conduction from the heated length of hair 40 passing therebetween in use, and by radiation and convection, but the pressing panels 126, 128 in the configuration of FIG. 3 will be significantly cooler than in the configuration of FIG. 2. The spacing S can be adjusted by the user (or by the controller) so as to set the desired temperature differential between the pressing panels and the heating panels.

The length of hair 40 is shown in FIGS. 2 and 3. It will be understood that the end 42 of the length of hair is the scalp end and the end 44 is the free end of the length of hair. As with a conventional hair straightener, the user initially positions the heating panels 116, 118 close to her scalp and during use moves the device away from her scalp, i.e. towards the left as drawn in FIGS. 2 and 3. The length of hair 40 is therefore progressively styled from the scalp end 42 to the free end 44, with the pressing panels 126, 128 following the heating panels 116, 118 along the length of hair. As with the embodiment of FIG. 1 therefore, the hair first passes between the heating panels 116, 118 where it is heated to a styling temperature (and not pressed), and then between the pressing panels 126, 128 where it is pressed.

Figure 4:
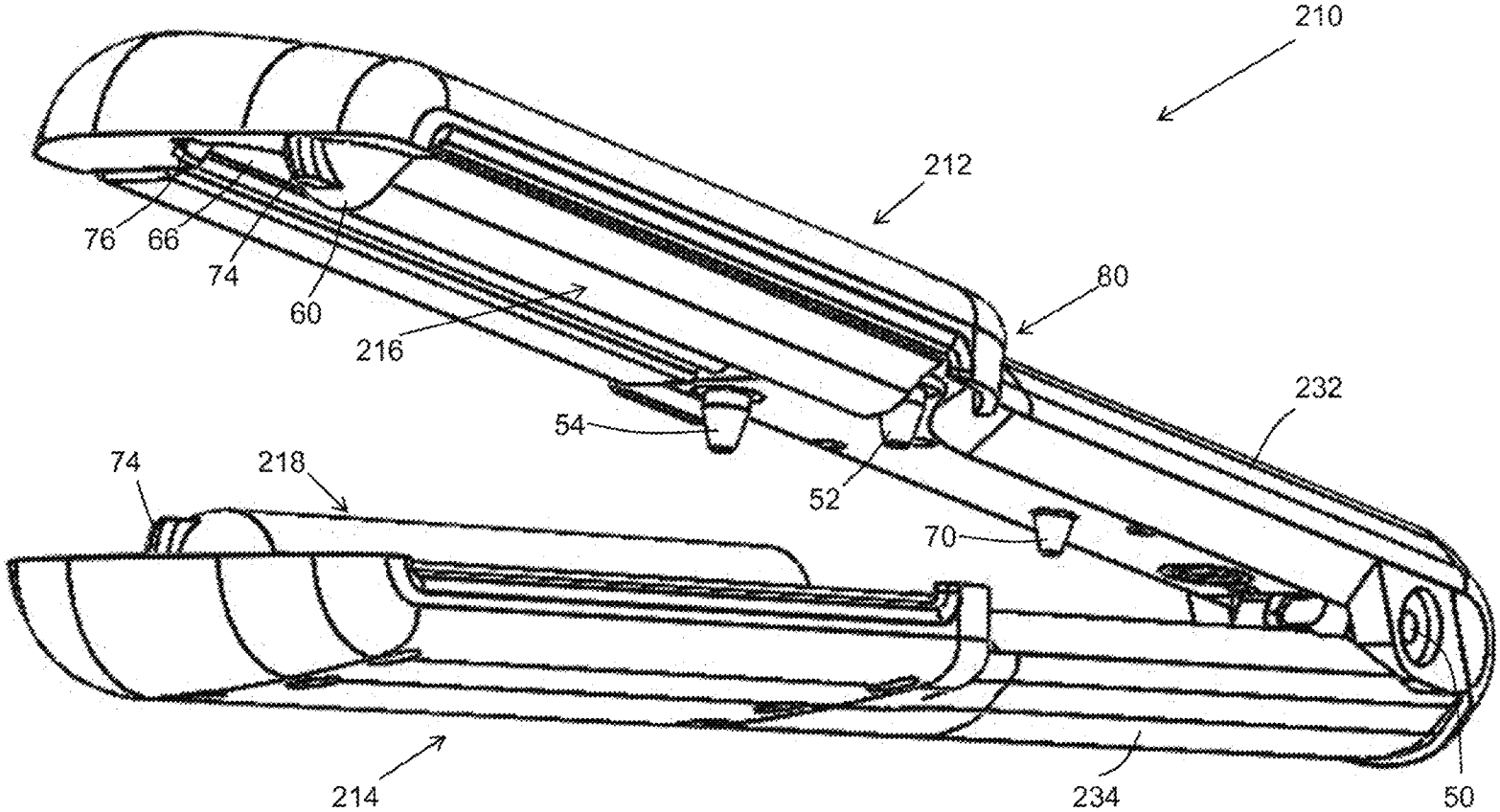
FIG. 4 shows a perspective view from below of an embodiment of hair styling device according to a third embodiment of the present invention.
Figure 5:
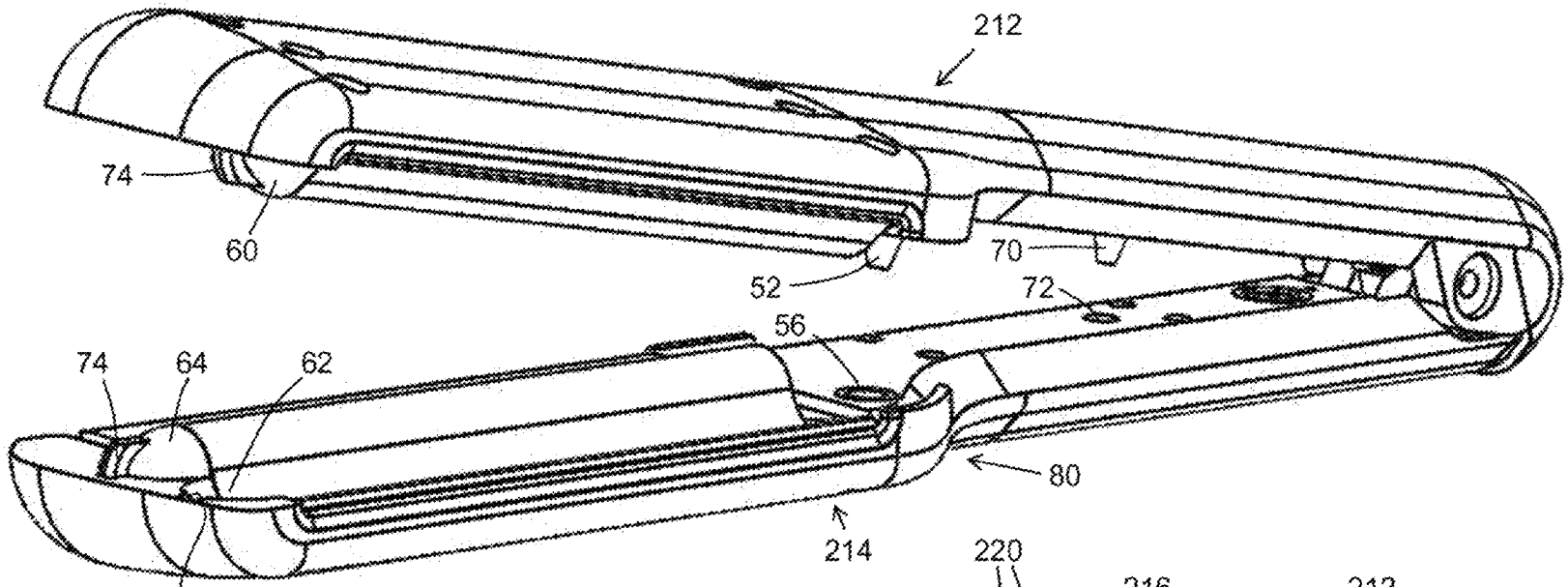
FIG. 5 shows a perspective view from above of the device of FIG. 4.
Figure 6:
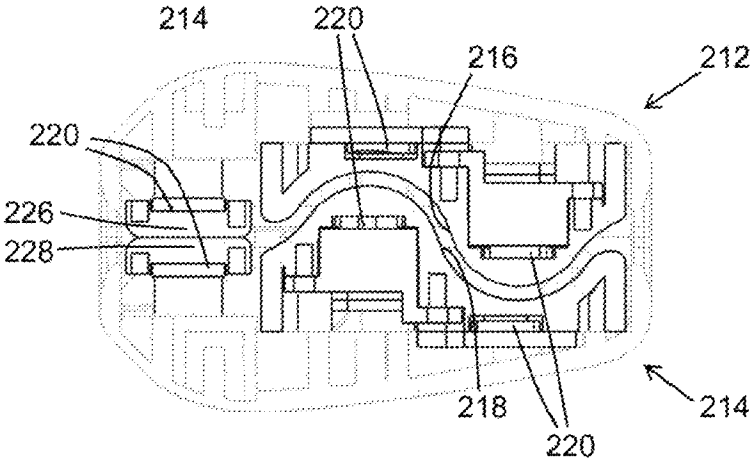
FIG. 6 shows a cross-sectional view through the heating panels and pressing panels of the hair-styling device of FIG. 4.

The third embodiment of hair styling device 210 shown in FIGS. 4 and 5 comprises a first member or arm 212 and a second member or arm 214. The first and second arms are movable relative to one another between the open or inoperative condition shown in FIGS. 4 and 5 and a closed or operative position as shown in FIG. 6.

The arms 212, 214 have respective handle parts 232, 234 which can be gripped with one hand by a user, the handle parts 232, 234 and thereby the arms 212, 214 being relatively moveable by way of a hinge or pivot joint 50, in known fashion. Also in known fashion the arms 212, 214 are biased apart to the inoperative condition of FIGS. 4 and 5, suitably by a spring (not seen) located close to the pivot joint 50.

The first arm 212 has a first heating panel 216 and the second arm 214 has a second heating panel 218. The first and second heating panels 216, 218 are metallic and each has ceramic heaters 220 (FIG. 6). The ceramic heaters 220 are actuated by an electrical current controlled by a controller (not shown) of the hair styling device 210. Preferably, the controller is able to control the temperature of the heating panels 216, 218 to one of several discrete temperatures so that the user can with practice determine the best temperature setting for her hair.

It will be understood that in the inoperative (open) position shown in FIGS. 4 and 5 the heating panels 216 and 218 are separated by a distance great enough to permit the introduction of a chosen length of hair between the heating panels 216, 218. In known fashion, when the length of hair has been inserted between the arms 212, 214, the hair styling device can be moved adjacent to the user's scalp to the position at which it is desired to commence the hair styling.

When correctly positioned relative to the user's scalp, the handle parts 232, 234 are squeezed together from the position shown in FIGS. 4 and 5 into the operative condition shown in FIG. 6. In the operative condition the pressing panels 226, 228 engage one another substantially across their full area, and the heating panels 216, 218 are close to one another but with a small gap through which the length of hair can pass.

Thus, even though it is possible in other embodiments for the heating panels to engage across some or all of their width, in this preferred embodiment a controlled gap is maintained between the heating panels 216, 218 so as to prevent the length of hair being pressed therebetween.

The first and second heating panels 216, 218 are corrugated, with the peaks and troughs of the first heating panel 216 facing the troughs and peaks respectively of the second heating panel 218. In this embodiment each heating panel comprises a whole peak and a whole trough (somewhat similar to a complete sine wave), but in other embodiments there can be less than one complete peak and/or less than one complete trough, or more than one complete peak and/or more than one complete trough, as desired.

The hair styling device 210 has cooperating formations which helps to maintain the separation of the heating panels 216, 218 in the operative position. The first cooperating formations are two projecting formations 52 and 54 carried by the first arm 212 and their corresponding recesses 56 in the second arm 214 (only one of the recesses 56 can be seen in FIG. 5).

The second cooperating formations are a projecting formation 60 carried by the first arm 212 and its corresponding recess 62 in the second arm 214.

The third cooperating formations are a projecting formation 64 carried by the second arm 214 and its corresponding recess 66 in the first arm 212.

It will be understood that the precise number, shape and location of the cooperating formations is not limited to those shown in the drawings, and one or more of the formations may be omitted, moved or changed without detriment to the invention. The location and shape of the second and third cooperating formations is, however, ideal because they are extensions of the peaks and troughs of the heating panels 216, 218.

Importantly, it is arranged that the projecting formations 52 (and 54) engage their respective recess 56, and the projecting formations 60 and 64 engage their respective recesses 62 and 66, when the arms 212, 214 are moved to the operative condition; the first and second heating panels 216, 218 are thereby held apart with the desired gap or separation across their full area.

It will be seen that the cooperating formations together act at either end of the heating panels 216, 218, and to either side of the heating panels. Together the cooperating formations can therefore ensure that the end-to-end separation and the side-to-side separation between the heating panels remains consistent despite any unbalanced or offset forces being applied to the first and second arms during use.

It will be seen that the hair styling device 210 has a further cooperating formation 70 and recess 72 to provide further structural stability to the device in its operative condition. In addition, the formation 70 can engage a switch in the recess 72 to actuate the heating elements if that is desired.

In addition to the spacing function of the cooperating formations, it will be understood that their tapering or curved shape also provides a guidance or alignment function, helping to ensure that the heating panels 214, 216 and pressing panels 226, 228 are properly aligned in the operative condition. The projecting formations 60 and 64 each carry a respective guide part 74 which locates snugly into a respective recess 76 to ensure the accurate and correct alignment of the arms 212, 214. It will be understood that the location of the guide parts 74 at the opposite end of each arm to the pivot joint 50 maximises their utility in guiding the arms as the arms are moved together to the operative position, and also maximises their utility in maintaining the correct alignment of the heating panels 216, 218 and pressing panels 226, 228 during use.

It will be seen that the heating panels 216, 218 are slightly offset from the handle portions 232, 234, i.e. there is a step 80 in one of the side edges of the arms 212, 214 whilst the other side edge is linear. It is necessary for the user to correctly orient the device relative to her head, and to move the device away from her head so that the length of hair passes firstly between the heating panels 216, 218 and then between the pressing panels 226, 228. It is therefore desirable that the user can readily appreciate which is the leading edge of the device and which is the trailing edge, even when the device is observed in a mirror. Making the device asymmetrical provides a clear visual indication to the user, i.e. the step 80 at one side of the device provides a clear visual indication of the edge which must be placed closest to the user's head.

It is desirable that the step 80 be to the side with the heating panels 216, 218. When the device it in use the user will press the handle parts 232, 234 together and thereby press the pressing panels 226, 228 together. It is desirable for the pressing panels 226, 228 to be in line with the handles so as to minimise any offset forces.

It will be seen from FIG. 6 that there is no direct connection between the heating panel 216, 218 and the pressing panel 226, 226 of each of the arms 212, 214 and on the contrary there is a small air gap therebetween. Notwithstanding that the pressing panels will be heated somewhat by the proximity of the heating panels, they can be at a significantly lower temperature than the heating panels. In this embodiment the pressing panels 226, 228 have their own heating elements 220 so that the temperature of the pressing panels can be controlled, independently of the temperature of the heating panels, and ideally to a lower temperature.

In practical variants of the hair styling device according to the second embodiment it is expected that the width W of the heating panels 116, 118 will be larger than the width w of the pressing panels 126, 128, ideally significantly larger so that the length of hair takes significantly longer to pass between the heating panels than to pass between the pressing panels. In one embodiment the width W is around 35 mm and the width w is around 10 mm-15 mm. Similarly for the third embodiment, with the width of the heating panels 216, 218 being significantly larger than the width of the pressing panels 226, 228 as is shown in particular in FIG. 6. In one preferred example of the third embodiment the width of the heating panels 216, 218 (corresponding to the width W of FIG. 3) is 35 mm and the width of the pressing panels 226, 228 (corresponding to the width w of FIG. 3) is 12 mm.

It will be understood that pressing panels 126, 128, 216, 218 which are 10-15 mm wide will not likely be able to effectively style hair on their own, even if the temperature of the pressing panels is around 200° C. (and for this reason conventional hair straighteners typically have heating panels which are more than 20 mm wide). Similarly, because the hair is not pressed between the heating panels 116, 118 it will not be effectively styled as it passes therebetween, notwithstanding that it can be heated to around 200° C. at that stage. Instead, it is the combination of the heating panels followed by the pressing panels which are required to style hair with the present invention. Hair can therefore be effectively styled by pressing the hair between panels which are only around 10-15 mm wide, the reduced width of the panels as compared to conventional hair straighteners reducing the likelihood of damage to the hair by reducing the path length (and time) for which the hair is pulled and pressed whilst at its most vulnerable to damage.

It will be understood that the arms (12, 14; 212, 214) of all embodiments of the hair styling device may be resiliently biased apart as in conventional hair straighteners, requiring the user to grip the arms and press them together in use. Alternatively, the arms are biased together, requiring the user to move them apart in use (one suitable alternative arrangement has a pivot between the handle parts of the arms and the heating and pressing panels). The latter arrangement has the first advantage that the user does not need to grip the arms to keep the heated panels in their operative position; less heat is therefore likely to be lost to the atmosphere, especially whilst the device is heating up prior to use. The latter arrangement has the second advantage that the heating panels are less likely to be inadvertently touched by the user as the device is manipulated so that the likelihood of burns is reduced. The latter arrangement has the third advantage that the pressure between the pressing panels in their operative position is controlled by the spring (or other resilient biasing means, or by magnet(s), for example) rather than the user's grip, so that a more consistent pressure is likely to be applied between the pressing panels during use, especially during extended periods of use. The latter arrangement is therefore likely to be less tiring for the user. The latter arrangement is also more aesthetically pleasing when the device is not in use.

In a preferred example of the third embodiment the amplitude of the corrugations is around one third of the wavelength (the amplitude is approximately 10 mm and the wavelength is approximately 35 mm); deeper or shallower corrugations (with an amplitude which is more than or less than one third of the wavelength respectively) can be provided as desired. It will be understood that deeper corrugations will increase the path length of the hair as it passes between the heating panels and will also increase the frictional resistance to movement of the hair between the heating panels. The relative amplitude and wavelength shown in FIG. 6 has been found to be a good compromise.

In a practical hair styling device made according to the third embodiment of FIGS. 4-6, and having heating panels 216 and 218 with the form and dimensions stated above, results in a path length for the hair passing between the heating panels of approximately 43 mm. The convoluted or corrugated form of the heating panels therefore provides a sufficient path length for the hair to attain the desired styling temperature, but with a significant reduction in the overall width of the device.

In certain embodiments the amplitude and wavelength of the corrugations can be made adjustable. In one particular embodiment the heating panels are provided by a flexible corrugated sheet, the ends of which sheet can be forced together so as to reduce the wavelength and increase the amplitude of the corrugations, or alternatively forced apart so as to increase the wavelength and reduce the amplitude of the corrugations, as desired.

In other embodiments the pressing panels can be provided by rollers. Notwithstanding that the rollers have a small contact area (similar to that of the embodiment of FIG. 1) they can nevertheless provide sufficient pressure to style the previously-heated hair.

In yet other embodiments the heating panels are provided by rollers with a corrugated periphery, the peaks of the corrugations of one roller loosely meshing with the troughs of the corrugations of the other roller, and vice versa (ideally so that the hair is not pressed as it passes between the corrugated rollers). The rollers can if desired be driven to rotate so as to assist the passage of hair therebetween.

The invention claimed is:

1. A hair styling device (10; 210) comprising a first member (12; 212) and a second member (14; 214), the first and second members being moveable relative to one another between an operative condition and an inoperative condition, the first member (12; 212) having a first heating panel (16; 116; 216) and the second member (14; 214) having a second heating panel (18; 118; 218), the first and second heating panels (16, 18; 116, 118; 216, 218) being corrugated with the peaks (22*a*) and troughs (24*a*) of the first heating panel (16; 116; 216) facing the troughs (24*b*) and peaks (22*b*) respectively of the second heating panel (18; 118; 218), the first and second heating panels being adapted to heat a length of hair (40) as the length of hair moves therebetween in use, the first and second heating panels (16,18; 116,118; 216,218) being closer together in the operative condition than in the inoperative condition and being spaced apart in the operative condition, the first member (12; 212) also having a first pressing panel (26; 126; 226) and the second member (14; 214) also having a second pressing panel (28; 128; 228), the first and second pressing panels being closer together than the heating panels in the operative condition.

2. A hair styling device (10; 210) according to claim 1 in which the pressing panels (26,28; 126,128; 226,228) are heated in use.

3. A hair styling device (10; 210) according to claim 2 in which the pressing panels (26,28; 126,128; 226,228) are heated in use to a lower temperature than the heating panels (16,18; 116,118; 216,218).

4. A hair styling device (10; 210) according to claim 2 in which each pressing panel (26,28; 126,128; 226,228) has a heating element (220).

5. A hair styling device (10; 210) according to claim 2 in which the pressing panels (26,28; 126,128) are heated by conduction from the heating panels (16,18; 116,118).

6. A hair styling device (10) according to claim 5 in which the first pressing panel (126) is movable towards and away from the first heating panel (116) and the second pressing panel (128) is movable towards and away from the second heating panel (118), whereby to adjust the temperature difference between the pressing panels and the heating panels.

7. A hair styling device (210) according to claim 1 in which the first member (212) and the second member (214) have at least one set of cooperating spacing formations (52,54,56; 60,62; 64,66) to maintain a predetermined gap between the heating panels (216, 218) in the operative condition.

8. A hair styling device (210) according to claim 7 in which the first member (212) and the second member (214) are elongate with first and second ends, the first and second members being connected together at a pivoting joint (50) adjacent to the first ends of the members, at least one cooperating formation (60,62; 64, 66) being adjacent to the second ends of the members.

9. A hair styling device (210) according to claim 8 in which there are two cooperating formations (60,62; 64,66) adjacent to the second ends of the members.

10. A hair styling device (210) according to claim 8 in which the cooperating formations (60,62; 64,66) are located at the ends of the corrugations.

11. A hair styling device (210) according to claim 10 in which the cooperating formations (60,62; 64,66) comprise a projection (60; 64) aligned with the peak of a corrugation and a recess aligned with a trough of a corrugation.

12. A hair styling device (210) according to claim 1 in which the first member (212) and the second member (214) have at least one set of cooperating aligning formations (52,54,56; 60,62; 64,66) to maintain the alignment of the members (212,214) in the operative condition.

13. A hair styling device (210) according to claim 1 in which at least one of the first member (212) and the second member (214) is asymmetrical in plan view.

14. A hair styling device (210) according to claim 13 in which both of the first member (212) and the second member (214) are correspondingly asymmetrical in plan view.

15. A hair styling device (210) according to claim 13 in which the asymmetrical member(s) (212,214) has a first side edge with a discontinuity (80).

16. A hair styling device (210) according to claim 15 in which the asymmetrical member(s) (212, 214) has a second side edge (212,214) which is substantially linear.

17. A hair styling device (210) according to claim 15 in which the asymmetrical member(s) (212,214) has a handle portion spaced from the heating and pressing panels, the step (80) being located between the handle portion and the panels.

18. A hair styling device (210) according to claim 15 in which the heating panel (216,218) is adjacent to the first side edge and the pressing panel (226,228) is adjacent to the second side edge.

19. A hair styling device according to claim 1 having a roller at a peak of a corrugation.

20. A hair styling device (10) according to claim 1 in which the first pressing panel (26; 126) is movable relative to the first heating panel (16; 116) between an operative position and an inoperative position, and the second pressing panel (28; 128) is movable relative to the second heating panel (18; 118) between an operative position and an inoperative position.

* * * * *